US005181867A

United States Patent [19]

Rodondi et al.

[11] Patent Number: 5,181,867

[45] Date of Patent: Jan. 26, 1993

[54] ELECTRICAL SLEEVE TERMINAL

[75] Inventors: Andrew F. Rodondi, Sharpsville, Pa.; Kenneth P. Cope, Leavittsburg; Joseph H. Gladd, Cortland, both of Ohio; James R. Savich, Sao Jose Dos Campos, Brazil

[73] Assignee: General Motors Corporation, Detroit, Mich.

[21] Appl. No.: 880,378

[22] Filed: May 8, 1992

[51] Int. Cl.[5] ..... H01R 13/00

[52] U.S. Cl. ..... 439/854; 439/881; 439/924

[58] Field of Search ..... 439/851-855, 439/877, 881, 924

[56] References Cited

U.S. PATENT DOCUMENTS 1,922,601 8/1933 Nolan ..... 439/854

4,367,006 1/1983 Rehbogen, Jr. et al. ..... 439/924

FOREIGN PATENT DOCUMENTS 213312 3/1987 European Pat. Off. ..... 439/881

OTHER PUBLICATIONS

BTM Corporation, four (4) page Brochure entitled "A Complete Inexpensive Sheet Metal Joining System".

*Primary Examiner*—Joseph H. McGlynn

*Attorney, Agent, or Firm*—Francis J. Fodale

[57] ABSTRACT

An electrical sleeve terminal of one piece construction comprises a split sleeve for engaging a mating terminal and a crimp barrel for attaching the terminal to an electric cable. The split sleeve has six circumferentially spaced beams that have contact dimples in an alternatively staggered arrangement to biasingly engage the mating terminal in two planes. The split sleeve has flanges at the respective edges of the split that are securely fastened together. The crimp barrel is an integral extension of one flange and a separate finger that is an integral extension of the other flange is fixed in the crimp barrel to engage the conductor of the electric cable.

11 Claims, 2 Drawing Sheets

ELECTRICAL SLEEVE TERMINAL

BACKGROUND OF THE INVENTION

This invention relates generally to electrical terminals and more specifically to electrical sleeve terminals that are attached to electric cables for use in high current automotive applications.

U.S. Pat. No. 4,720,157 granted to Charles R. Nestor and Robert G. Plyler Jan. 19, 1988 discloses electrical sleeve terminals for high current automotive applications including one illustrated in FIGS. 7 and 8 that is designed for attachment to an electric cable. This prior art terminal is a complicated assembly of several pieces. Consequently it is expensive to manufacture. Another drawback of the multipiece construction is the presence of several electrical interfaces between the contact strips of the cylinder that engages the mating terminal and the crimp barrel attached to the electric cable. These several electrical interfaces make it difficult to produce a reliable electrical connection which depends on the quality of the electrical contact at each interface.

SUMMARY OF THE INVENTION

The object of this invention is to provide an improved electrical sleeve terminal that is attached to electric cable for use in high current automotive applications that is very reliable and inexpensive to manufacture.

A feature of the invention is that the electrical sleeve terminal is of one piece construction to minimize the electrical interfaces between the mating terminal and the electric cable.

Another feature of the invention is that the electrical sleeve terminal is mated and unmated with a rigid mating terminal such as a solid pin easily.

Another feature of the invention is that the electrical sleeve terminal has a finger disposed in the conductor engaging area of the crimp barrel which improves current flow, improves heat dissipation and eliminates need for polygage stock.

Still another feature of the invention is that the electrical sleeve terminal has a split sleeve that has elongated flanges at the respective longitudinal edges of its seam that are securely fastened together so that the separate finger is fixed or immobile in the conductor engaging area of the crimp barrel.

Yet another feature of the invention is that the electrical sleeve terminal has elongated flanges that are flat so as to provide a mold seal surface so that the terminal can be used in a mold over construction.

Yet another feature of the invention is that the electrical sleeve terminal has a sleeve comprising a plurality of equally circumferentially spaced longitudinal beams that have contact dimples that biasingly engage a mating terminal at several points around its diameter when it is mated with the sleeve.

Still yet another feature of the invention is that the contact dimples are staggered, i.e. alternately located in longitudinally spaced planes, to stabilize the electrical interface between the sleeve and the mating terminal.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
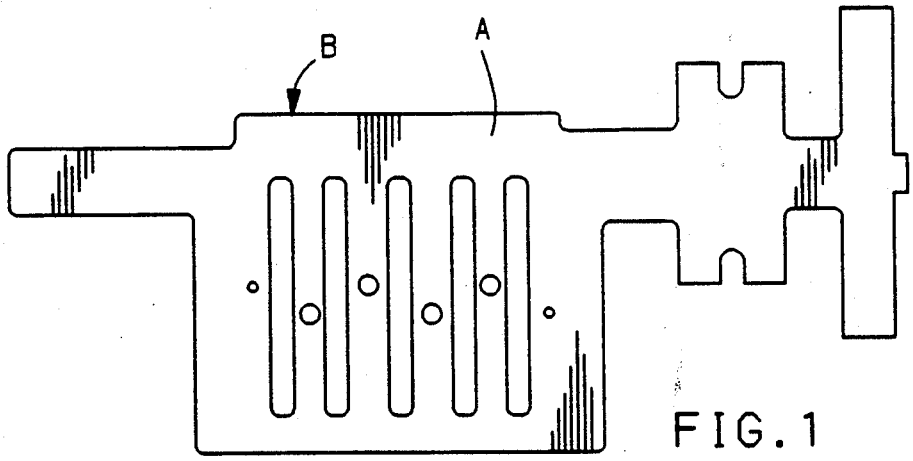
FIG. 1 is a plan view of a sheet metal blank for making an electrical sleeve terminal in accordance with this invention.

Referring now to sheet 1 of the drawing, the electrical sleeve terminal 10 is one piece construction and made from a suitable electrically conductive material preferably a ¾ hard Olin Alloy 151 ZHC Copper. This alloy, which is available from Olin Corporation, Brass Group, has a nominal composition of 0.1% zirconium with the remainder copper. The composition limits are 0.05–0.15% zirconium; a maximum of 0.005% aluminum; a maximum of 0.005% manganese; a maximum of 0.005% iron, with the further restriction of a maximum of 0.01% aluminum, manganese and iron in total; and the remainder copper.

Figure 3:
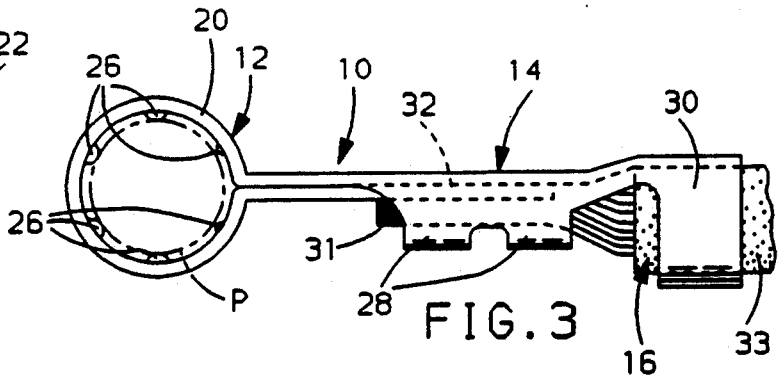
FIG. 3 is a top view of the electrical sleeve terminal taken substantially along the line 3—3 of FIG. 2 looking in the direction of the arrows.

The electrical sleeve terminal 10 comprises a sleeve 12 for receiving a pin terminal P, represented by a dashed outline in FIG. 3, and a crimp barrel 14 for attaching the electrical sleeve terminal 10 to an electric cable 16.

Figure 2:
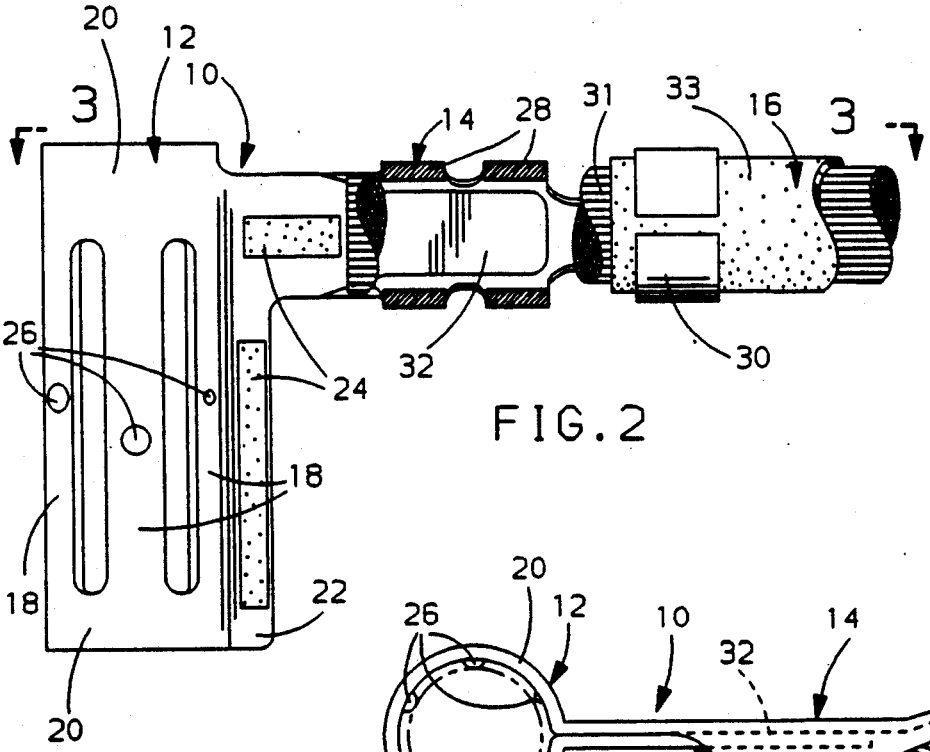
FIG. 2 is a front view of an electrical sleeve terminal in accordance with this invention made from the blank of FIG. 1.
Figure 4:
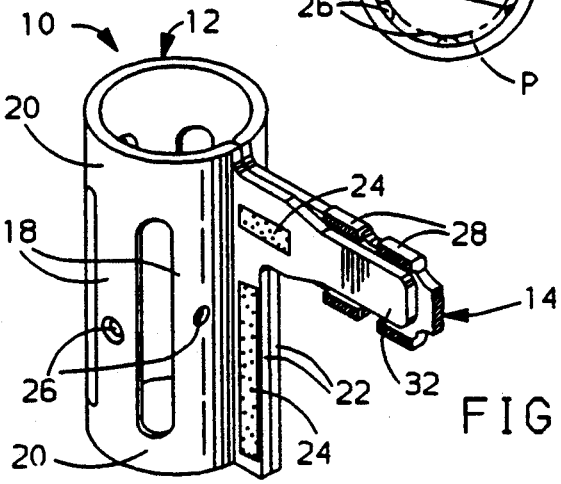
FIG. 4 is a perspective view of the electrical sleeve terminal shown in FIGS. 2 and 3.

The sleeve 12 is made from a slotted flat portion A of a sheet metal blank B shown is FIG. 1 that is rolled into a split cylinder as shown in FIGS. 2, 3 and 4. The rolled split sleeve 12 thus comprises a plurality of equally circumferentially spaced longitudinal beams 18, in this particular instance six, attached to upper and lower bands or rings 20. The sleeve 12 further includes elongated flanges 22 at the respective longitudinal edges of the split that is formed when the flat portion A of the blank B is rolled into a cylinder. These elongated flanges 22 are securely fastened to each other, in this case by ultrasonic welds in the flanges 22 and near portions of the crimp barrel 14 which are indicated at 24 in FIGS. 2 and 4.

Each beam 18 has a contact dimple 26 that protrudes radially inwardly of the sleeve 12 as best shown in FIG. 3. The mating pin terminal P is sized so that these contact dimples 26 biasingly engage the pin terminal P at several points around its diameter when it is inserted into the sleeve 12 primarily due to the resilience of the beams 18. The contact dimples 26 are preferably staggered as shown in the drawings so that alternate contact dimples are located on two longitudinally spaced planes. Thus three equally circumferentially spaced contact dimples 26 are located on an upper plane and three equally circumferentially spaced dimples 26 are located on a lower plane. This staggered arrangement stabilizes the interface between the sleeve 12 and the pin terminal P particularly with regard to relative rocking movement between them.

The crimp barrel 14 is an integral extension of one of the flanges 22. It comprises conductor crimp wings 28 and insulation crimp wings 30 which are crimped around the conductor 31 and insulation 33 of the electric cable 16 respectively Besides the crimp barrel 14, the cable attachment means further includes a separate finger 32 that is an integral extension of the other of the flanges 22. The finger 32 lies against the bottom of the trough joining the conductor crimp wings 28, that is, the conductor engaging portion of the crimp barrel 14, as shown in FIGS. 2 and 4, so that the finger 32 engages the conductor 31 when the crimp wings 32 are crimped around the conductor 31. The finger 32 is fixed or immobile in the conductor engaging portion of the crimp barrel 14 by reason of the ultrasonic welds 24 so that in the flanges 22 and portions of the crimp barrel 14 and finger 32 near the flanges 22, the finger 32 does not move when the sleeve terminal 10 is attached to the electric cable 16. The finger 32 improves current flow and heat dissipation from the sleeve 12 to the conductor 31 of the electric cable 16. It also eliminates any need for polygage stock to construct the sleeve terminal 10, primarily due to the second layer of material that the finger 32 provides in the conductor engaging portion of the crimp barrel 14. For instance we have found that an electrical sleeve terminal made of 0.020 in. (0.51 mm) thick ¾ hard Olin Alloy 151 ZHC Copper stock has a current carrying capacity of 200 amps or better.

The elongated flanges 22 are also preferably flat to provide mold seal surfaces when the electrical sleeve terminal 10 is used in a molded over construction to provide a sealed connector.

Referring now to sheet 2 of the drawing, another electrical sleeve terminal 100 in accordance with this invention is illustrated in FIGS. 5–9. This terminal is also of one piece construction and made from a suitable electrically conductive material preferably a ¾ hard Olin Alloy 151 ZHC Copper as before.

Figure 8:
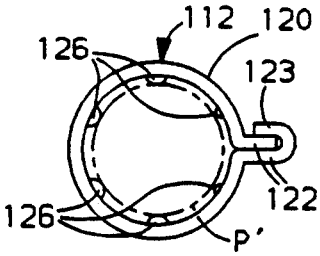
FIG. 8 is a partial bottom view of the electrical sleeve terminal taken substantially along the line 8—8 of FIG. 6 looking in the direction of the arrows.

The electrical sleeve terminal 100 comprises a sleeve 112 for receiving a pin terminal P', represented by a dashed outline in FIG. 8, and a crimp barrel 114 for attaching the electrical sleeve terminal 100 to an electric cable 116.

Figure 5:
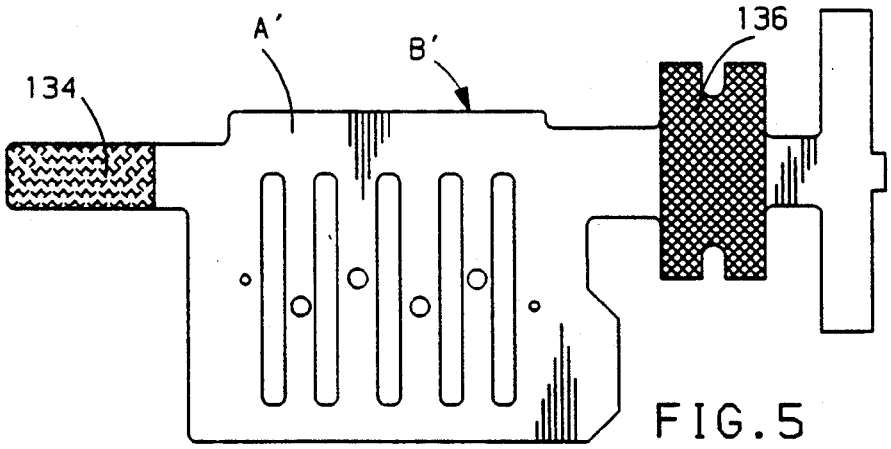
FIG. 5 is a plan view of a sheet metal blank for making another electrical sleeve terminal in accordance with this invention.
Figure 6:
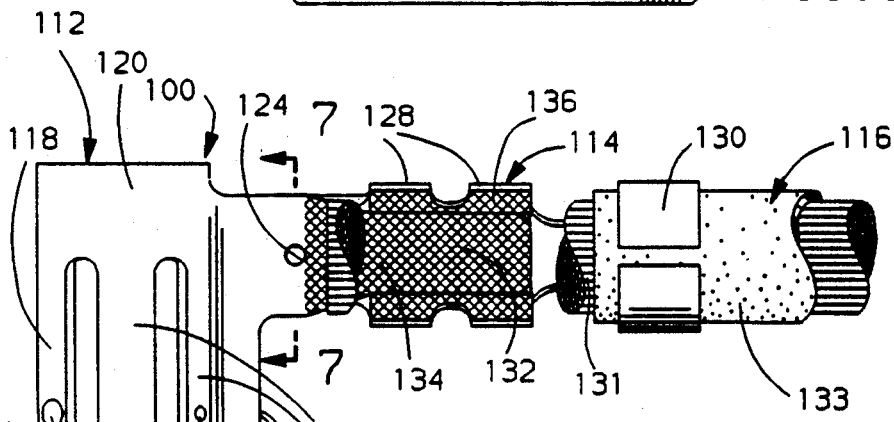
FIG. 6 is a front view of a second electrical sleeve terminal in accordance with this invention made from the blank of FIG. 5.
Figure 9:
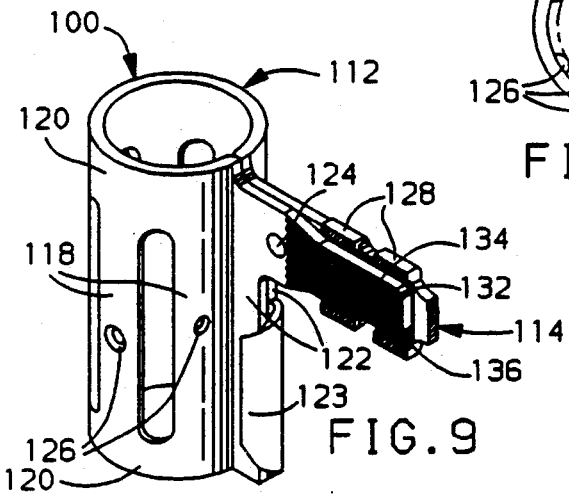
FIG. 9 is a perspective view of the electrical sleeve terminal shown in FIGS. 6, 7 and 8.

The sleeve 112 is made from a slotted flat portion A' of a sheet metal blank B, shown is FIG. 5 that is rolled into a split cylinder as shown in FIGS. 6, 8 and 9. The rolled split sleeve 112 thus comprises a plurality of equally circumferentially spaced longitudinal beams 118, in this particular instance six, attached to upper and lower bands or rings 120. The sleeve 112 further includes elongated flanges 122 at the respective longitudinal edges of the split that is formed when the flat portion A' of the blank B' is rolled into a cylinder These elongated flanges 122 are securely fastened to each other by an interlocking lip 123 that is an integral extension of one of the flanges 122 and that is wrapped or crimped over the edge of the other flange 122 as shown in FIGS. 6 and 9. The flanges 122 are further secured by integral nesting interlocking buttons 124 that are shown in FIG. 7 and described below.

Each beam 118 has a contact dimple 126 that protrudes inwardly of the sleeve 112 as best shown in FIG. 8. The mating pin terminal P' is sized so that these contact dimples 126 biasingly engage the pin terminal P' at several points around its diameter when it is inserted into the sleeve 112 primarily due to the resilience of the beams 118. The contact dimples 126 are preferably staggered as shown in FIGS. 5, 6, 8 and 9 of the drawings so that alternate contact dimples are located on two longitudinally spaced planes as explained in connection with the earlier construction illustrated in sheet 1.

The crimp barrel 114 is an integral extension of one of the flanges 122. It comprises conductor crimp wings 128 and insulation crimp wings 130 which are crimped around the conductor 131 and insulation 133 of the electric cable 116 respectively. Besides the crimp barrel 114, the cable attachment means further includes a separate finger 132 that is an integral extension of the other of the flanges 122. The finger 132 lies against the bottom of the trough joining the conductor crimp wings 128 or conductor engaging portion of the crimp barrel 114, as shown in FIGS. 6 and 9, so that it engages the conductor 131 when the crimp wings 128 are crimped around the conductor 131. The finger 132 is fixed or immobile in the conductor engaging portion of the crimp barrel 114 by reason of the crimped over interlocking lip 123 and the nesting interlocking buttons 124 so that the finger 132 does not move when the sleeve terminal 100 is attached to the electric cable 116.

Figure 7:
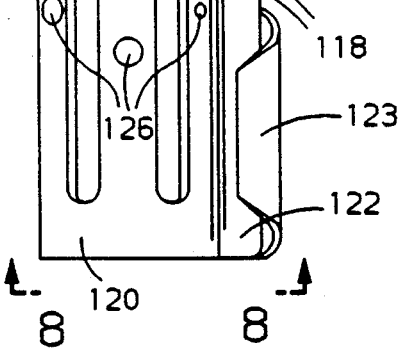
FIG. 7 is a sectional view of the electrical sleeve terminal taken substantially along the line 7—7 of FIG. 6 looking in the direction of the arrows.
Figure 7:
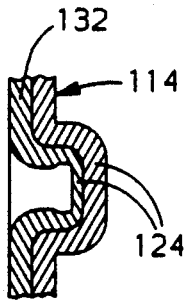

The nesting buttons 124 which are integrally formed in the finger 132 and the crimp barrel 114 respectively and are formed in an interlocking fashion as shown in FIG. 7 so that the finger 132 and crimp barrel 114 are securely and immovably fixed to each other at this location. The nesting interlocking buttons 124 are located near the flanges 122 so that these buttons do not interfere with the conductor 131 being gripped by the conductor crimp wings 128.

The conductor engaging surface 134 of the finger 132 (i.e. the bottom surface of the blank shown in FIG. 5) and the conductor engaging surface 136 of the crimp barrel 114 (i.e. the top surface of the blank shown in FIG. 5) are knurled as shown in FIGS. 5, 6 and 9. When the finger 132 is folded against the bottom of the crimp barrel 14, it engages and partially covers the knurled conductor engaging surface 136 as shown in FIG. 6. Engagement of the central portion of knurled surface 136 further enhances immobility of the finger 132 with respect to the conductor engaging portion of the crimp barrel 114. On the other hand, the exposed end portions of the knurled surface 136 and the knurled surface 134 of the finger 132 enhance conductivity between the conductor 131 and the crimp barrel 114 and between the conductor 131 and the finger 132 when the conductor 131 is gripped by the conductor crimp wings 128.

As before, the finger 132 improves current flow and heat dissipation from the sleeve 112 to the conductor 131 of the electric cable 116 and eliminates any need for polygage stock to construct the sleeve terminal 100.

Figure 10:
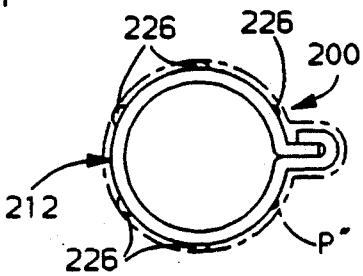
FIG. 10 is a partial bottom view of yet another electrical sleeve terminal in accordance with this invention.

FIG. 10 shows another electrical sleeve terminal 200 in accordance with this invention. The electrical sleeve terminal 200 is exactly the same as the electrical sleeve terminal 100 except that the split sleeve 212 has dimples 226 which protrude radially outwardly rather than inwardly. Thus the electrical sleeve terminal 200 is adapted to engage a mating socket terminal P', indicated by the dashed line P'', rather than a mating pin terminal as is the case in the earlier construction. The contact dimples 226 are also preferably staggered as explained in connection with the contact dimples 26 and the contact dimples 126 of the earlier constructions. The outwardly projecting dimples 226 can also be used in the construction shown in sheet 1 where the flanges 22 are ultrasonically welded together.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical sleeve terminal of one piece construction having a sleeve for engaging a mating terminal and a crimp barrel for attaching the electrical sleeve terminal to an electric cable comprising:

the sleeve having a split and a plurality of equally circumferentially spaced longitudinal beams attached to upper and lower bands, the sleeve further including elongated flanges at the respective longitudinal edges of the split that are securely fastened to each other, each beam having a contact dimple that protrudes radially of the sleeve to biasingly engage a mating terminal at several points around its diameter when it is mated with the sleeve, the contact dimples being staggered so that alternate dimples are located in longitudinally spaced planes to stabilize the interface between the sleeve and the mating terminal when it is mated with the sleeve, the crimp barrel being an integral extension of one of the flanges and comprising conductor crimp wings and insulation crimp wings that are adapted for crimping around the conductor and insulation of an electric cable respectively, and the terminal further including a separate finger that is an integral extension of the other of the flanges and that is fixed in the bottom of the crimp barrel so that it engages the conductor of an electric cable when the crimp barrel is crimped around the electric cable.

2. The electrical sleeve terminal as defined in claim 1 wherein the elongated flanges are flat to provide mold seal surfaces when the electrical sleeve terminal is used in a molded over construction.

3. An electrical sleeve terminal of one piece construction having a sleeve for engaging a mating terminal and a crimp barrel for attaching the electrical sleeve terminal to an electric cable comprising:

the sleeve having a split and a plurality of circumferentially spaced longitudinal beams attached to upper and lower bands, the sleeve further including flanges at the respective longitudinal edges of the split that are securely fastened to each other, each beam having a contact that protrudes radially of the sleeve to biasingly engage a mating terminal at several points around its diameter when it is mated with the sleeve, the crimp barrel being integrally attached to the sleeve at one of the longitudinal edges of the split and comprising conductor crimp wings that are adapted for crimping around a conductor of an electric cable, and the terminal further including a finger that is integrally attached to the sleeve at another of the longitudinal edges of the split, the finger being fixed in a portion of the crimp barrel so that it contacts the conductor of an electric cable when the conductor crimp wings are crimped around the conductor.

4. The electrical sleeve terminal as defined in claim 3 wherein the flanges are securely fastened to each other by interlocking means.

5. The electrical sleeve terminal as defined in claim 3 wherein the flanges are securely fastened to each other by an interlocking lip on one flange that is crimped over the edge of the other flange and the finger and the crimp barrel are securely fastened to each other by interlocking buttons that are located near the flanges to avoid interference with the conductor crimp wings being crimped about the conductor.

6. The electrical sleeve terminal as defined in claim 3 wherein the flanges are securely fastened to each other by ultrasonic welds.

7. The electrical sleeve terminal as defined in claim 6 wherein the finger is ultrasonically welded to the crimp barrel at a location near the flanges.

8. An electrical sleeve terminal of one piece construction having a sleeve for engaging a mating terminal and a crimp barrel for attaching the electrical sleeve terminal to an electrical cable comprising:

the sleeve having a plurality of circumferentially spaced longitudinal beams attached to upper and lower bands, the sleeve having a split and flanges at the respective longitudinal edges of the split that are secure fastened to each other, each beam having a contact that protrudes radially of the sleeve to biasingly engage a mating terminal at several points around its diameter when it is mated with the sleeve, and the crimp barrel being an integral extension of one of the flanges.

9. The sleeve terminal as defined in claim 8 wherein the contacts are dimples which are staggered so that alternate dimples are located in longitudinally spaced planes to stabilize the interface between the sleeve and the mating terminal when it is mated with the sleeve.

10. The sleeve terminal as defined claim 8 wherein the contacts are dimples, the crimp barrel comprises conductor wings that are adapted for crimping around a conductor of an electric cable, the terminal further includes a finger that is an integral extension of the other of the flanges, and the flanges are securely fastened to each other so that the finger is fixed in the crimp barrel and contacts the conductor when the conductor crimp wings are crimped around the conductor core.

11. The sleeve terminal as defined in claim 10 wherein the flanges are elongated and flat to provide mold seal surfaces when the terminal is used in a molded over construction.

* * * * *